United States Patent [19]

Blanco

[11] 4,008,725

[45] Feb. 22, 1977

[54] SMOKER'S PIPE CONSTRUCTION

[76] Inventor: Francisco Blanco, 501 N.E. 69th St., Miami, Fla. 33138

[22] Filed: Aug. 11, 1975

[21] Appl. No.: 603,768

[52] U.S. Cl. ..... 131/184 A

[51] Int. Cl.[2] ..... A24F 3/02; A24F 9/02

[58] Field of Search ..... 131/184, 184 A, 184 B

[56] References Cited

UNITED STATES PATENTS

| | | | |
|---|---|---|---|
| 737,550 | 8/1903 | Barz | 131/184 A X |
| 1,104,654 | 7/1914 | Gilliland | 131/184 A |
| 1,532,050 | 3/1925 | Drapeau et al. | 131/184 A |
| 2,563,349 | 8/1951 | McAllaster | 131/184 A |

*Primary Examiner*—Stephen C. Pellegrino
*Attorney, Agent, or Firm*—Ernest H. Schmidt

[57] ABSTRACT

The bowl of a smoker's pipe is provided with a circular interior bottom plate or grate rotatably supported on a control pin extending laterally outwardly of one side of the pipe bowl and terminating in a handle for rocking and rotating the bottom plate from side to side in scraping relation with interior sidewall portions of the pipe bowl for automatically loosening and scraping away the charred remnants of consumed tobacco.

2 Claims, 4 Drawing Figures

SMOKER'S PIPE CONSTRUCTION

This invention relates to smoker's pipes and is directed particularly to a device in the bowl of such pipes to facilitate the cleaning of the bottom of the bowl or charred and compacted smoking tobacco and ash without the use of separate cleaning implements.

In pipe smoking, it is common practice for a smoker to compact smoldering pipe tobacco down into the bottom of the pipe bowl from time to time to achieve the desired smoke concentration and drag or draft. This has a tendency to encrust the bowl bottom with charred tobacco and ash which must be removed from time to time, usually after each smoking session. It has heretofore been common practice to use pen knives, or specialized pipe bowl scraping implements of one kind or another for this purpose. The annoying habit of tapping the bowl upside-down upon hard surfaces is also commonly resorted to in attempts to dislodge ash, etc., from the pipe. The principal disadvantage in the use of scraping or cleaining tools is that, because they are separate from the pipe, they have a tendency to become lost, misplaced or otherwise unavailable when needed.

It is, accordingly, the principal object of this invention to overcome the disadvantages in the use of separate smoker's pipe bowl cleaining implements by the provision, as an integral part of the bowl construction, of a bowl bottom cleaning device having manually controlled means extending outwardly of the bowl.

A more particular object of the invention is to provide a pipe bowl bottom cleaning device in the form of a non-combustible, substantially circular bottom plate or grate within the bottom of the pipe bowl for supporting the pipe tobacco from underneath, and which is rockably and rotatably supported on a control pin extending laterally-outwardly of one side of the pipe bowl and terminating in handle means for rocking and rotating the bottom plate from side to side in scraping relation with interior sidewalls portions of the pipe bowl for automatically loosening and scraping away the charred remnants of consumed tobacco.

Another object of the invention is to provide a smoker's pipe of the character described which will be simple in construction, economical in cost, attractive in appearance, easy to operate, and long-wearing and effective in use.

Other objects, features and advantages of the invention will be apparent from the following description when read with reference to the accompanying drawings. In the drawing, wherein like reference numerals denote corresponding parts throughout the several views.

Figure 1:
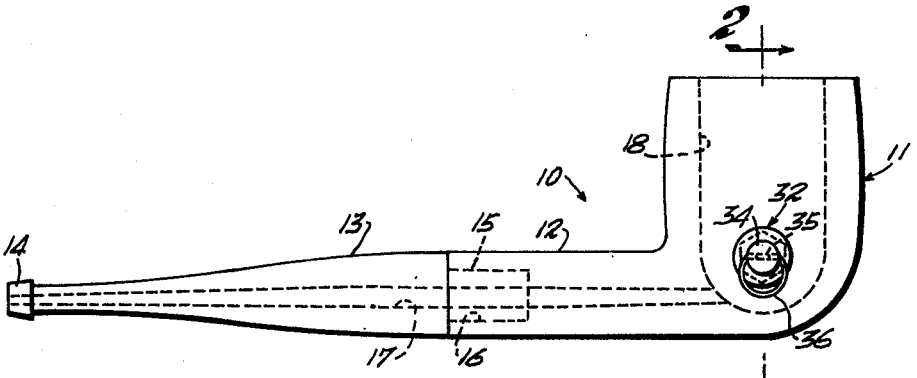
FIG. 1 illustrates, in side elevation, a preferred form of smoker's pipe embodying the invention.

Referring now in detail to the drawings, reference numeral 10 designates, generally, a preferred form of smoker's pipe embodying the invention, the same being comprises of the usual tobacco bowl 11 formed at its lower end with an outwardly-extending cylindrical shank portion 12 having a removable pipe stem 13 terminating in a bit 14. The pipe stem 13, which is preferably made of a strong synthetic plastic material, may be integrally formed with the usual reduced-diameter plug portion 15 at its inner end, of such size as to be received and frictionally retained within a shank bore 16 to maintain the pipe in assembled relation. The stem 13 and shank 12 are formed with the usual small diameter axial bore 17 opening into the bottom of the bowl opening or tobacco receiving recess 18 for passage of the tobacco smoke when smoking.

Figure 2:
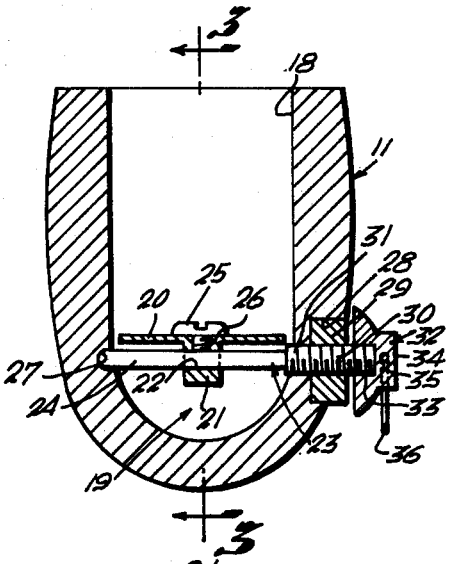
FIG. 2 is a tranverse vertical cross-sectional view through the pipe bowl, taken along the line indicated at 2—2 of FIG. 1 in the direction of the arrows.
Figure 3:
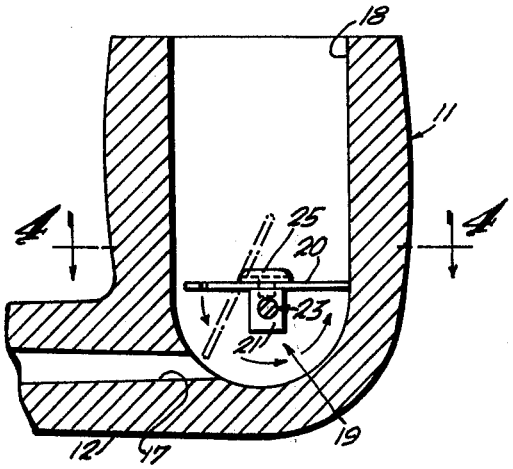
FIG. 3 is a longitudinal vertical cross-sectional view of the pipe bowl, taken along the line indicated at 3—3 of FIG. 2 in the direction of the arrows.

The bowl bottom cleaing device embodying the invention, designated generally by reference numeral 19 in FIGS. 2 and 3, comprises a circular bowl bottom plate or grate 20, which may be of stamped stainless steel, for example, integrally formed with a central, axially downwardly-extending sleeve portion 21, said sleeve portion being provided with a transversely-extending through bore 22. The grate 20 is carried by a rocking pin 23 extending substantially diametrically through the pipe bowl 11 from side to side, as best illustrated in FIG. 2. The rocking pin 23 is integrally formed with a support pin portion 24 which extends through the bore 22 of the grate sleeve portion 21 to which said grate is removably secured as by a jam screw 25 threadingly engaged in internal threads 26 formed within said sleeve portion. The outer end of the support pin portion 24 of the rocking pin 23 is journalled in a blind recess 27 provided within the interior of the pipe bowl 11.

Means is provided for rotatably mounting the rocking pin 23 within the side wall of the pipe bowl 11 opposite the blind recess 27. To this end, an outside wall portion of the pipe bowl is provided with a circular recess 28 press-fitted or otherwise secured within which is an internally-threaded nut 29. The inner end of the support pin portion 24 of the rocking pin 23 extends into a somewhat increased diameter, externally-threaded shank portion 30 threadingly recieved within the nut 29 and extending through a cylindrical opening 31 communicating between the interior of the pipe bowl and opening centrally into the threaded nut recess 28. A dome-shaped cap nut 32 having a blind, internally-threaded opening 33 is threaded on the outwardly-projecting end of the rocking pin shank portion 30, said cap nut being of such diameter as to cover the internally threaded nut 29. The outer end portion 34 of the cap nut 32 is provided with a transverse, diametrically-extending through opening 35 through which a loose-fitting wire ring 36 is captively received.

Figure 4:
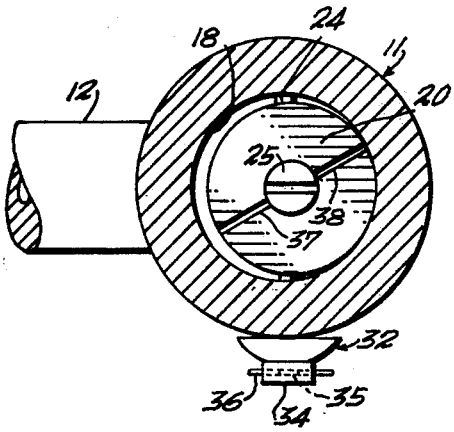
FIG. 4 is a horizontal cross-sectional view of the pipe bowl taken along the line 4–4 of FIG. 3 in the direction of the arrows.

As illustrated in FIG. 4, the grate 20 is preferably formed with a pair of diametrically-opposed radially-extending slots 37, 38 provided for through passage of the smoke of burning tobacco while smoking.

In use of the pipe, the bottom grate 20 will be turned to the horizontal position as illustrated by the full-line representation thereof in FIGS. 2, 3 and 4, after which a new charge of pipe tobacco will be tamped in place in the usual fashion. In this connection it will be noted that when the grate is in its normal horizontal position, the through opening 35 in the cap nut 32 will extend horizontally so that the manipulating wire ring 36 falls centrally downwardly from the outside of the pipe bowl. Thus, the horizontal position of the grate can readily be determined without the necessity of looking into the bowl of the pipe. After filling with tobacco, the pipe will be smoked in the usual fashion, while tamping of the smoldering or burning tobacco down until the bowl from time to time to effect the smoke concentration and draw desired by the smoker. Whenever, after a smoking session, the smoker wishes to clean the pipe bowl, it is only necessary for him to rock and turn the grate 20 a few times by manipulation of the rocking pin 23 with use of the wire ring 36 as a handle, whereupon the peripheral edge of said grate, as illustrated in FIGS. 3 and 4, will scrape along inner wall portions of the interior of the pipe bowl. As illustrated by the broken line representation thereof in FIG. 3, in its rocking motion the grate 20 will scrape particularly well of that portion of the interior of the pipe bowl communicating with the smoke passage axial bore 17, to keep this opening clear. It is to be noted that the smooth hard surface of the metallic grate 20 characteristically will not combine with the charred or ash products of burning tobacco, so that such residual ash or charred matter will fall away easily upon the slightest tapping of the pipe if it should not dislodge automatically upon the rocking and scraping action as described above.

While I have illustrated and described herein only one form in which the invention can conveniently be embodied in practice, it is to be understood that this form is presented by way of example only and not in a limiting sense. The invention, in brief, comprises all the embodiments and modifications coming withing the scope and spirit of the following claims.

I claim:

1. In a smoker's pipe, the combination comprising, a tobacco bowl portion, a pipe shank portion integrally formed with and extending outwardly of said bowl portion, a bottom plate member within said bowl portion and serving as a grate for supporting tobacco to be burned in said bowl portion when the pipe is being smoked, said bottom plate having peripheral edge portions in close proximity to inner wall portions of said tobacco bowl portion, and manually controllable means for rockably and rotatively supporting said bottom plate with respect to said pipe bowl portion to scrape away the charred remnants and ash of consumed tobacco after a smoking session, said manually controllable bottom plate supporting means comprising a control pin extending laterally outwardly of one side of said bowl portion, means journalling said control pin for rotative movement with respect to said bowl portion, handle means at the outer end of said control pin, means for securing said bottom plate member with respect to said control pin for movement in unison therewith, said bottom plate member being substantially circular in shape, said bottom plate member securing means comprising a flat support plate portion integrally formed with an axially downwardly-extending sleeve portion, said sleeve portion having a transversely-extending through bore through which said control pin is received, and a jam screw threadingly engaged within said sleeve portion and in abutment with a sidewall portion of said controll pin.

2. A smoker's pipe as defined in claim 1, wherein said handle means comprises a cap member secured at the outer end of said control pin and having a diametrically-extending through opening, and a loose fitting wire ring captively recieved in said through opening.

* * * * *